US006400327B1

(12) United States Patent
Galvin

(10) Patent No.: US 6,400,327 B1
(45) Date of Patent: Jun. 4, 2002

(54) LOADED ANTENNA

(75) Inventor: Richard W. Galvin, Riverside, CA (US)

(73) Assignee: Barjan Products, LLC, East Moline, IL (US)

( * ) Notice: Subject to any disclaimer, the term of this patent is extended or adjusted under 35 U.S.C. 154(b) by 0 days.

(21) Appl. No.: 09/885,787

(22) Filed: Jun. 19, 2001

(51) Int. Cl.[7] ..... H01Q 1/32
(52) U.S. Cl. ..... 343/749; 343/715
(58) Field of Search ..... 343/713, 715, 343/722, 749, 872, 895; H01Q 1/32

(56) References Cited

U.S. PATENT DOCUMENTS 3,461,455 A 8/1969 Rowe ..... 343/749
4,179,698 A * 12/1979 Liautaud ..... 343/715
4,190,839 A * 2/1980 Liautaud ..... 343/715
4,546,357 A * 10/1985 Laughon et al. ..... 343/702
4,882,591 A * 11/1989 Galvin et al. ..... 343/715
5,016,021 A * 5/1991 Newcomb ..... 343/722
6,104,355 A * 8/2000 Wilson ..... 343/749
6,215,451 B1 4/2001 Hadzoglou ..... 343/715

* cited by examiner

*Primary Examiner*—Tho Phan
(74) *Attorney, Agent, or Firm*—Leon D. Rosen

(57) ABSTRACT

An antenna with a loading coil (26), is constructed with the spacing between turns of the coil and the diameter of the coil being precisely fixed in a mass-produced loading coil. Three rib members (80, 82, 84) are provided that have slots (90) that receive the turns of the coil, with the rib members being circumferentially spaced about about the axis (32) of the coil. The lower ends (94) of the rib members are fixed in radial position to the bottom (144) of the loading coil frame (140), and the upper ends (92) of the rib members are connected to a ring (130) that braces the tops of the rib member to each other and that expands the diameter of the upper portion of the coil, to form a rigid combination of coil and rib members.

12 Claims, 2 Drawing Sheets

LOADED ANTENNA

BACKGROUND OF THE INVENTION

Our earlier U.S Pat. No. 6,104,355 describes an antenna with a loading coil lying in a frame, with vibration of coil turns being avoided by a plurality of adhesive fixing strips that fix the separation of coil turns. Applicant finds that after the coil is wound, it may deform during handling, and this requires careful tuning of each unit by stretching or squeezing its length, before applying the fixing strips. The need for such tuning increases the cost of manufacture. The loading coil should be of minimum weight, since it lies at the top of an upstanding base. An antenna with a loading coil that could be manufactured at low cost while assuring repeatable precise location of the coil, in a construction of minimum weight, would be of value.

SUMMARY OF THE INVENTION

In accordance with one embodiment of present invention, an antenna loading coil is provided, which enables rapid manufacture while assuring predetermined axial spacing of the coil turns, assuring a predetermined diameter of the coil, and assuring location of the coil concentric with the axis of the frame while keeping the coil turns spaced from the side walls of the frame. The loading coil includes at least three members that each have slots that closely receive the turns, with the rib members circumferentially spaced about the axis. A spacing ring that is coupled to the upper ends of the rib members, pushes apart the rib members to slightly expand the diameter of the upper end of the coil. The lower ends of the rib members are mounted on a lower end of the frame at a fixed spacing from the frame axis by abutment of shoulders of the rib members and of the frame lower part. The coil has upper and lower connection ends to which termination lugs are crimped and soldered, for easy mounting of the coil. The wire of the coil is formed of a copper tube instead of solid copper.

The novel features of the invention are set forth with particularity in the appended claims. The invention will be best understood from the following description when read in conjunction with the accompanying drawings.

DESCRIPTION OF THE PREFERRED EMBODIMENT

Figure 1:
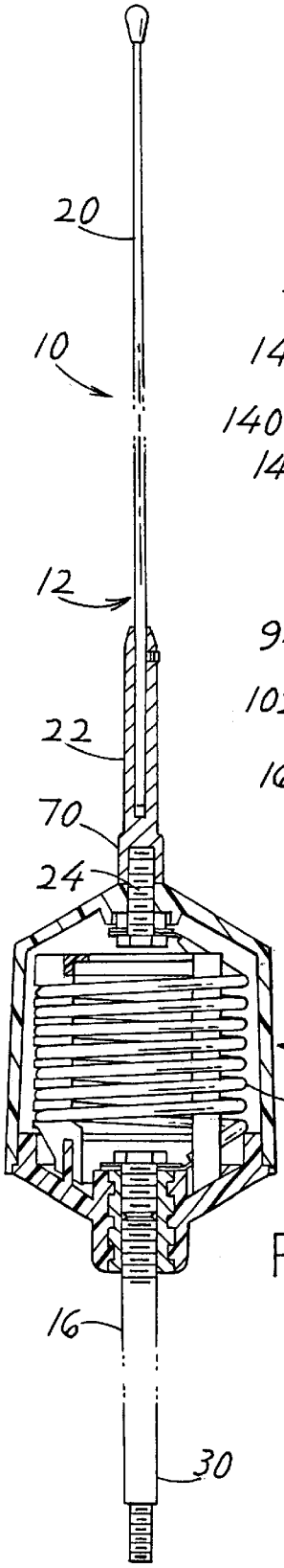
FIG. 1 is a sectional side view of an antenna constructed in accordance with one embodiment of the present invention.

FIG. 1 illustrates an antenna 10 that is designed to be mounted on a vehicle, and designed for transmission and reception of radio signals of a frequency on the order of magnitude of that of citizen band radio frequencies (about 27 MHz). The antenna includes a coil assembly 14 connected to upper and lower conductors 12, 16. The upper conductor includes a semi-flexible upper radiator device 20, a mast 22, and a coupling 24 that is coupled to the top of a coil device 26. The lower conductor 16 includes a base rod 30 whose lower end is designed to mount on a vehicle.

Figure 2:
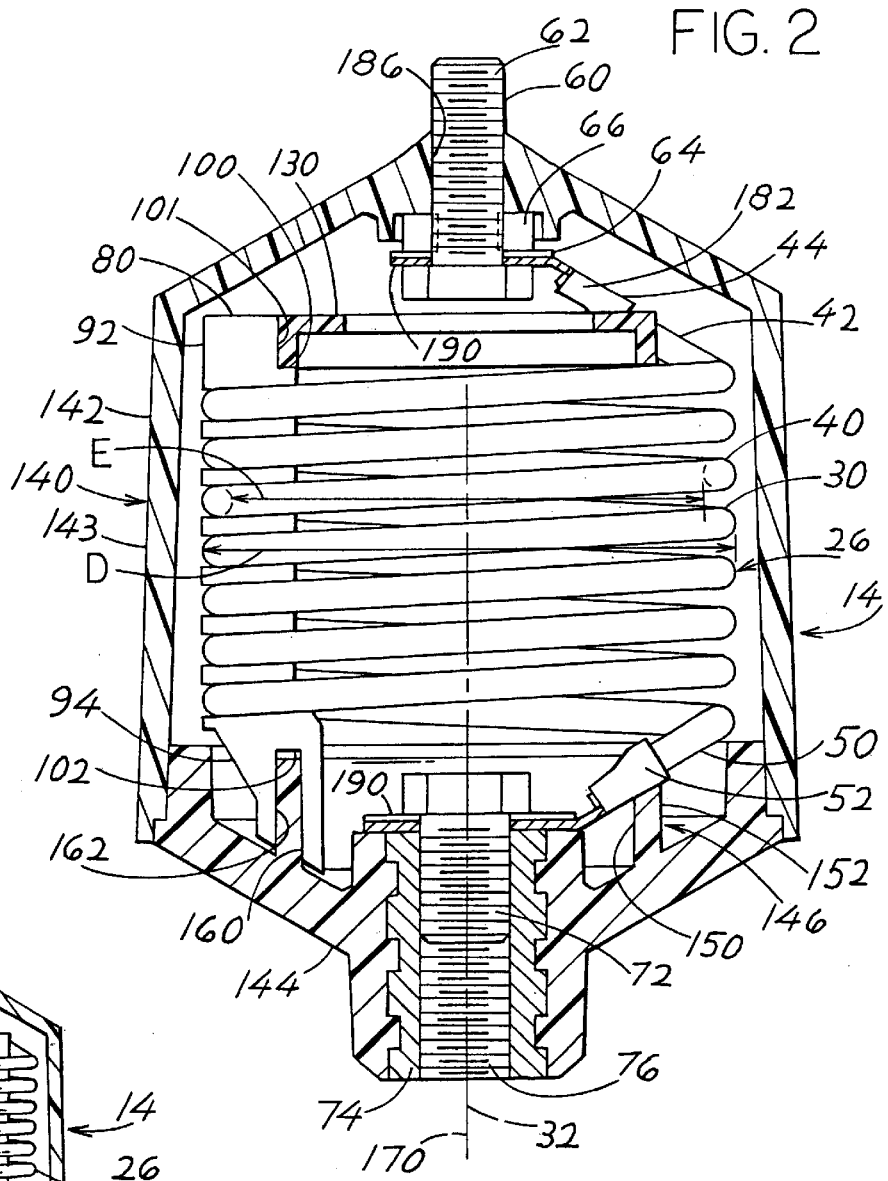
FIG. 2 is an enlarged view of the loading coil of the antenna of FIG.1, but with only one rib member in place.

As shown in FIG. 2, the coil device 26 includes a coil 30 that is wound in a helix about a primarily vertical axis 32. The upper conductor 12 extends upwardly along the same axis and the lower conductor 16 generally downwardly along the same axis. The coil is formed by a plurality of turns of an electrically conductive wire 40, with the particular coil shown having seven turns. The wire has an upper wire portion forming an upper connector end 42 of the coil device that extends at an upward incline, with a termination lug 44 crimped and soldered to the upper end of the wire. The wire has a lower wire portion or lower coupling end 50 that extends at a downward incline and that has a termination lug 52 fixed to the lower end of the wire.

The upper termination lug 44 has a ring part that extends around the shaft 60 of a screw 62. A lock washer 64 and jam nut 66 prevent rotation of the termination lug 44 after the mast is attached. As shown in FIG. 1, the mast is attached by threading its lower end 70 onto the top of the screw 62 of FIG. 2.

The lower termination lug 52 lies around the threaded shaft of a screw 72 which is screwed into a metal insert 74 in the frame, with a lock washer lying against the ring part of the termination lug to prevent loosening of the lower screw. The lower conductor 16 is attached by screwing it into the threaded bore 76 of the insert 74.

Figure 4:
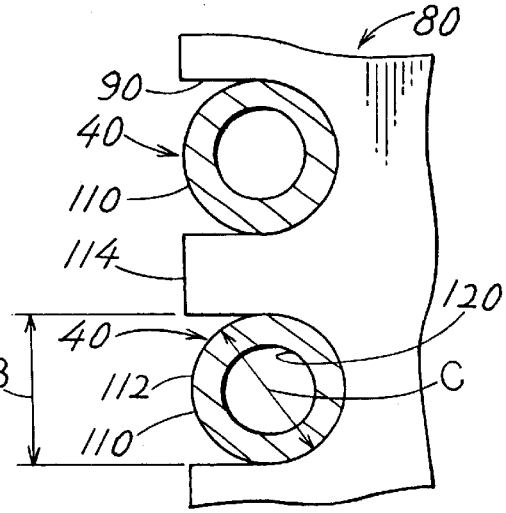
FIG. 4 is a view taken on line 4—4 of FIG. 3.
Figure 3:
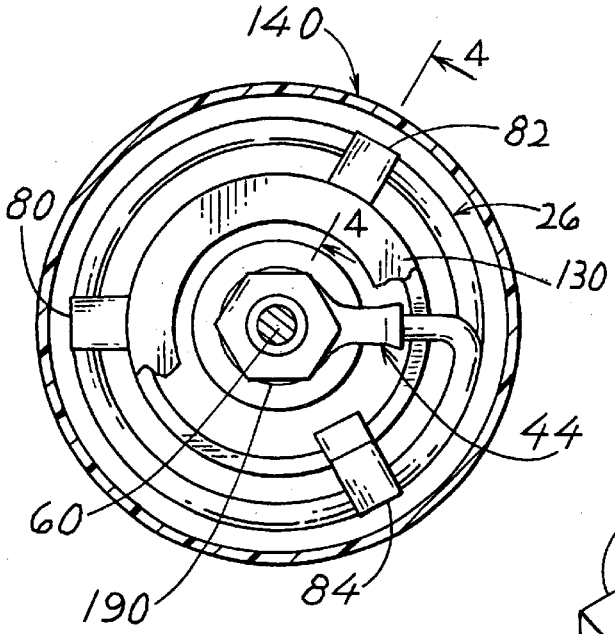
FIG. 3 is atop sectional view of the loading coil of FIG. 2, with a portion. of the spacing ring cut away and with one of the rib members shown in its initial state, prior to installation of the spacing ring.
Figure 5:
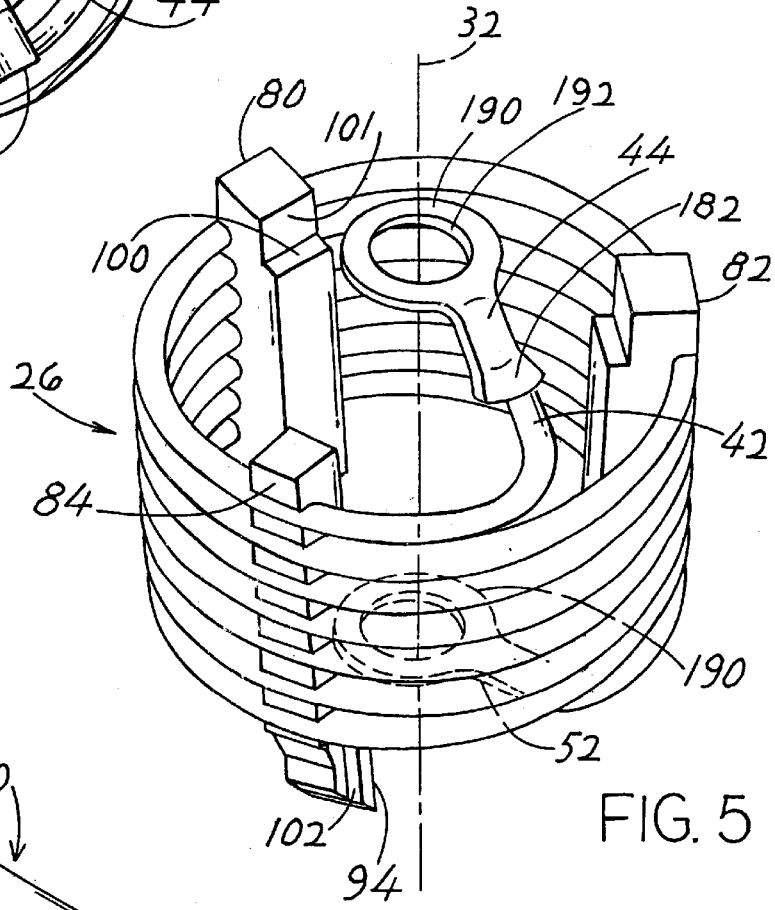
FIG. 5 is a top isometric view of the finished coil with the three rib members mounted thereon.
Figure 6:
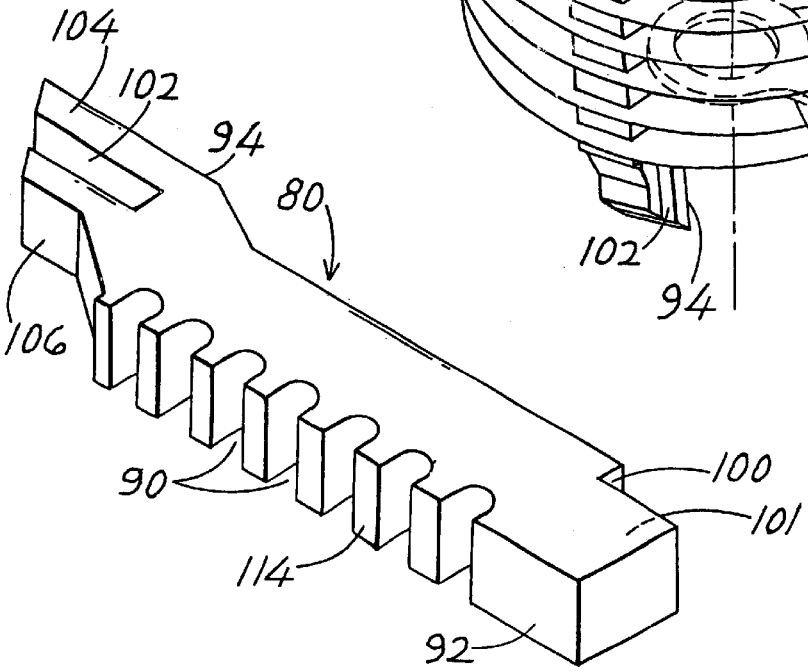
FIG. 6 is an isometric view one of the rib members of FIG. 5.

As shown in FIG. 5, the coil device 26 includes three rib members 80, 82, 84 that are circumferentially spaced about the axis 32 of the coil. The three rib members are identical, except for staggered grooves to accommodate winding pitch, with one of them 80 being shown in FIG. 6. Each of the rib members is molded of a dielectric polymer material. Each rib member has plurality of slots 90 that are spaced apart in a direction parallel to the axis of the coil. The rib has upper and lower ends 92, 94, with the upper end having a horizontal ledge 100 and the lower end having a vertical slot, or groove 102 formed by a pair of actually-extending slot walls 104,106. As shown in FIG.4, each turn 110 of the wire 40 that forms the coil, lies in one of the slots 90 of a rib member such as 80. The radially outer side 112 of each wire turn lies substantially even with the radially outer side 114 of the rib member. The turns 110 are installed by pushing them into the slots 90. There is an interference fit between the wire and the height B of the slot, so the wire is tightly gripped by the walls of a slot.

It is noted that the wire 40 is not solid, but is in the form of a tube with a passage 120 at its center. The passage 120 reduces the weight of the coil, and yet does not change the impedance of the coil. At the high frequencies at which the antenna is used (a plurality of megahertz) current passes near the outer surface of the wire. The outside of the coil is silver plated to reduce resistance.

The lighter weight of the coil minimizes the weight to be held at the top of the vehicle-mounted base. In a loading coil of the type illustrated that applicant has constructed, the tubing had an outside diameter C of 125 mils (1 mil equals one thousandth inch) while the passage 120 has a diameter of 65 mils. This reduces the weight of the coil by about 27%, compared to a solid coil of the same outside diameter. Each slot had an initial height B of 123 mils, for an interference of about 2 mils.

FIG. 2 shows that the coil assembly includes a spacer ring 130 that lies between the upper ends 92 of the three rib members. The spacer ring lies on the horizontal ledges 100 and is adhesively bonded to the rib members. The spacer ring outside diameter is chosen to press the three rib members apart, to slightly expand the diameter of the upper portion of the wire coil 30. By slightly expanding the coil diameter, applicant obtains a fixed coil diameter along the upper portion of the coil. Also, expansion of the coil results in the coil turns pressing firmly against the radially inner ends of the slots in the rib members, which prevents the wire of the coil from sliding and thereby turning slightly relative to the rib members. In a coil device of the type illustrated that applicant has designed, the coil had an outside diameter D of 2.10 inch, and an inside diameter E of 1.85 inch. The outside diameter of the spacer ring was chosen to expand the diameter of the top of the coil by about 5 mils.

The coil assembly includes a rigid frame 140 with upper and lower parts 142, 144 that are both molded of dielectric material. The metal insert 174 is molded in place in the frame bottom part 144. The frame bottom part has an upstanding ridge 146 which preferably extends 360 about the axis 32 for rigidity, although it could be molded with interruptions. The ridge 146 is received in the groove 102 of each rib member, and is fixed in place with adhesive. The ridge has radially inner and outer shoulders 150, 152 that radially abut radially inner and outer shoulders 160, 162 formed by the walls of the groove 102 in the lower end of each rib member. The radial abutment, or engagement, of the ribs with grooves in the rib members, fix the radial positions of the lower ends of the rib members. This assures that the coil 30 is mounted accurately concentric with the axis 170 of the housing, which is concentric with the coil axis. This also assures that the portions of the ribs between the upper and lower ends, that intimately hold the coil turns, are spaced from the side walls 143 of the frame. The height of each groove 102 is greater than the radial width of the slot, and is more than twice as great, to fix the orientation of the rib members.

The upper and lower connection ends 42,50 (FIG. 2) of the coil device, are terminated to the termination lugs 44, 52, by crimping and soldering the wire ends such as 42 to termination ends 182 of the lugs. The ring shaped part 190 of the lug is easily mounted on the frame by merely slipping one of the screws through the ring part, with the lower screw 72 tightened in place to the frame, and with the upper screw 62 tightened when the jam nut 66 is screwed onto it. Although termination lugs are well known for connection to the ends of wires, they have not been used for connection to the ends of a loading coil. Applicant winds the coil so the hole 192 (FIG. 5) in the ring part 190 of each lug lies on the axis 32 of the coil, to minimize change in the coil configuration after the coil is constructed and during mounting.

To assemble the coil assembly, applicant first mounts the three rib members 80, 82, 84 on the coil as shown in FIG. 5, by merely pressing the rib members radially outwardly against the coil turns. Then, the spacer ring 130 (FIG. 2) is installed by applying adhesive to the ledges 100 and adjacent walls 101 of the ribs and pressing the spacer ring in place. The spacer ring is constructed of low loss dielectric material. A next (or previous) step is to mount the lower ends 94 of the ribs on the bottom part 144 of the frame. Adhesive is applied in the grooves 102 of the ribs, and the grooves are moved down to receive the upstanding ridges 146 of the frame bottom parts.

The lower screw is installed downwardly through the ring of the lower termination lug 52 and tightened. The upper screw 62 is inserted upwardly through the ring of the upper termination lug 44 and screwed onto the jam nut 66. The upper part 142 of the frame is moved down carefully so the top screw 62 projects upward through a smooth bore 186 in the upper frame part. The jam nut engages molded detail in the frame which inhibits the nut's rotation. The antenna mast 22 can then be screwed down tightly to hold the upper screw in place. Applicant leaves a small clearance between the tops of the ribs and the inside of the upper frame part 142 to allow for manufacturing tolerances. However, drop of elastomer adhesive (e.g. silicon rubber) may be applied to the upper part of each rib member to anchor it to the frame.

Thus, the invention provides a loading coil for an antenna that includes upper and lower conductors that extend upwardly and downwardly, respectively, from the coil assembly, wherein the coil assembly is easily maintained at a fixed diameter and concentric with the axis of the frame, the coil is lightweight, and the coil is easily mounted in place. The coil is fixed in position by a plurality of rib members, preferably at least three of them, which have slots that closely receive turns of the coil to accurately space the turns. A spacer ring coupled to the top of the rib members, slightly expands the circle on which the rib members lie, to expand the upper portion of the coil. The rib members have lower ends that are mounted on a lower part of the frame, with shoulders on the rib members and frame lower part that prevent radial movement of the rib members with respect to the frame. The coil is formed by a tube, with the hollow passage of the tube reducing the weight of the coil without affecting its properties at the frequencies of interest. Lugs are fixed to the coil ends, the lugs having rings that lie on the coil axis to facilitate the electrical coupling of opposite ends of the coil to conductive screws that connect to the upper and lower conductors of the antenna.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A loading coil assembly for an antenna that has upper and lower conductors for connection to the coil assembly, where the coil assembly includes an electrically conductive wire with a coil portion that is wound into a coil that has a plurality of turns and a primarily vertical coil axis and upper and lower coil ends, and a frame that surrounds said coil and that has frame upper and lower ends, including:

a plurality of dielectric rib members, each rib member having upper and lower ends and radially inner and outer sides, and each rib member having a plurality of slots that extend into said radially outer sides and that each closely receives one of said turns, with said rib members being circumferentially spaced about said axis:

a dielectric spacer ring which is coupled to said upper ends of said rib members at locations that push apart said rib members to expand the diameter of the upper end of said coil.

2. The loading coil device described in claim 1 wherein:

said frame has a lower end with radially facing frame shoulder portions, said lower ends of said rib members have radially facing rib shoulders that radially abut said frame shoulder portions, to fix the radial position of said coil lower end.

3. The loading coil assembly described in claim 1 wherein:

said frame lower end has an upstanding ridge and said rib member lower ends each has a vertical groove that receives said upstanding ridge.

4. The loading coil assembly described in claim 1 wherein:

said slots in said rib members each have slot walls that lie in an interference fit with said coil portion.

5. A loading coil assembly for an antenna that has upper and lower conductors for connection to the coil assembly, where the coil assembly includes an electrically conductive wire with a coil portion that is wound into a coil that has a plurality of turns and a primarily vertical coil axis and upper and lower coil ends, and a frame of rigid material that surrounds said coil and that has frame upper and lower ends, including:

at least three rib members, each rib member formed of dielectric material and having upper and lower ends and radially inner and outer sides, and each rib member having a plurality of slots that extend into its radially outer side and that each closely receives one of said turns, with said rib members being circumferentially spaced apart about said axis;

at least a first end of each rib member is fixed in position on said frame, with a first end of said frame and said first end of each rib member having engaged radially-facing shoulders that abut one another;

of said first ends of said frame and said first ends of said rib members, one has a vertically extending ridge and the other has a vertically extending groove that closely receives the ridge.

6. The coil described in claim 5 wherein:

each of said rib members has a second end that is opposite said first end and including a dielectric spacer ring that is connected to said second ends of all of said rib members.

7. The coil described in claim 5 including said upper conductor of said antenna, and wherein:

said wire is substantially rigid and includes an upper connection end extending from a corresponding end of said coil portion;

said upper conductor has an end lying adjacent to said housing and having a threaded bore on lying said axis, and including a screw with a threaded shaft that is screwed into said threaded bore;

a terminal lug that has a rear portion that surrounds and is fixed to said wire upper connection end with said terminal lug having a ring that surrounds said threaded shaft of said screw, and with said screw being screwed tightly into said threaded bore of said upper conductor.

8. An antenna which includes an electrically conductive wire with a coil portion that is wound into a coil that has a plurality of turns and a primarily vertical coil axis and upper and lower coil ends, a rigid frame that surrounds said coil and that has frame upper and lower ends, an upper conductor coupled to said coil upper end and mounted on said frame and extending upwardly therefrom along said axis, and a lower conductor coupled to said coil lower end and attached to said frame lower end, wherein:

said frame includes a lower end with an upstanding ridge; and including a plurality of rib members, each rib member having upper and lower ends and a plurality of slots that each closely receives one of said turns of said coil, with said rib members being circumferentially spaced about said axis;

of said frame lower end and the lower ends of each rib member, one has a vertical groove and the other has a vertically-extending ridge that fits into the groove, to thereby fix the radial position and the orientation of said coil lower end.

9. The antenna described in claim 8 wherein:

the lower end of each of said rib member has the vertical groove, and said frame lower end has a lower wall with said ridge extending upwardly from said lower wall, with each vertical groove having a greater height than its radial width.

10. A loading coil device for an antenna, wherein the loading coil device includes an electrically conductive wire with a coil portion that is wound into a coil that has a plurality of turns and a primarily vertical coil axis and with upper and lower wire ends, wherein:

said loading coil device includes a pair of termination lugs that each has a termination end fixed to one of said wire ends and a ring end with a hole;

said upper wire end extending radially inwardly and at an upward-radially inward incline, and said lower wire end extending radially inwardly and at a downward-radially inward incline, with said termination lugs each fixed to a corresponding wire end and positioned with the hole in the ring end lying on said vertical coil axis.

11. The loading coil device described in claim 10 wherein:

said wire is formed of a tube with a central passage.

12. The loading coil device described in claim 10, including:

a housing surrounding said coil and having a lower housing end with an upstanding ridge;

at least three dielectric rib members that each has a plurality of slots that each receives one of said coil turns, with each rib member having a lower end with a primarily vertical slot that receives said ridge.

* * * * *